US007235929B2

(12) United States Patent
Inami

(10) Patent No.: US 7,235,929 B2
(45) Date of Patent: Jun. 26, 2007

(54) MAGNETRON

(75) Inventor: Masahiro Inami, Tochigi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 314 days.

(21) Appl. No.: 11/038,027

(22) Filed: Jan. 21, 2005

(65) Prior Publication Data

US 2005/0173429 A1 Aug. 11, 2005

(30) Foreign Application Priority Data

Jan. 23, 2004 (JP) ..... P. 2004-016140

(51) Int. Cl.
*H01J 25/50* (2006.01)

(52) U.S. Cl. ..... 315/39.51; 315/39.67; 315/39.71; 219/761

(58) Field of Classification Search ..... 315/34, 315/39.51, 39.67, 39.71, 39.75, 39.77, 312; 219/538, 552, 756, 761
See application file for complete search history.

(56) References Cited

U.S. PATENT DOCUMENTS

| | | | | |
|---|---|---|---|---|
| 3,732,459 | A * | 5/1973 | Oguro et al. | 315/39.51 |
| 4,223,246 | A * | 9/1980 | Osepchuk | 315/39.71 |
| 4,900,985 | A * | 2/1990 | Tashiro et al. | 315/39.51 |
| 5,432,405 | A * | 7/1995 | Ochiai et al. | 315/39.51 |
| 5,977,713 | A * | 11/1999 | Ochiai et al. | 315/39.51 |
| 6,351,071 | B1 * | 2/2002 | Itoh | 315/39.51 |
| 6,573,484 | B1 * | 6/2003 | Yue | 219/541 |
| 6,724,146 | B2 * | 4/2004 | Small | 315/39.77 |
| 2001/0004192 | A1 * | 6/2001 | Miki et al. | 315/39.71 |
| 2002/0070671 | A1 * | 6/2002 | Small | 315/39.51 |
| 2004/0118841 | A1 * | 6/2004 | Shon et al. | 219/761 |
| 2006/0118554 | A1 * | 6/2006 | Aisenbrey | 219/761 |

FOREIGN PATENT DOCUMENTS

| | | |
|---|---|---|
| JP | 60-53418 | 11/1985 |

* cited by examiner

*Primary Examiner*—Trinh Dinh
*Assistant Examiner*—Tung Le
(74) *Attorney, Agent, or Firm*—McDermott Will & Emery LLP

(57) ABSTRACT

A magnetron 10 is equipped with a helical filament 39, as an element of a cathode assembly, arranged on a central axis of an anode cylindrical body 13. Assuming that a resistance value of the filament 39 before forming the carbonized layer is R1 and a resistance value of the filament 39 after forming the carbonized layer is R2, a thickness of the carbonized layer 42 of the filament 39 is determined such that a carbonization rate Rx defined by the equation "Rx={(R2−R1)/R1}×100" in a range of from 30 to 50%.

1 Claim, 7 Drawing Sheets

FIG. 6A - - Prior Art - -
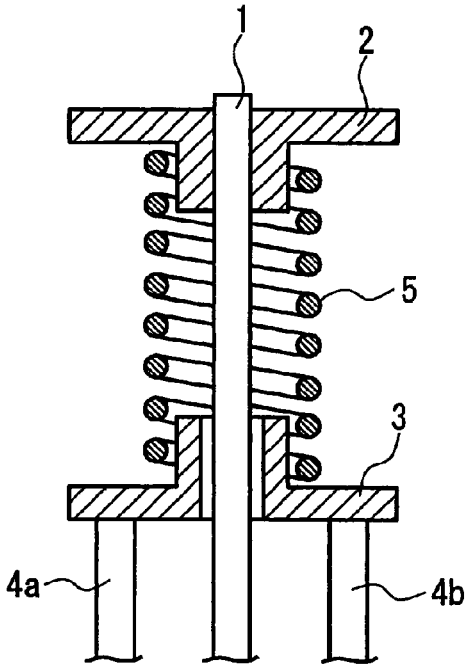
FIG. 6B - - Prior Art - -
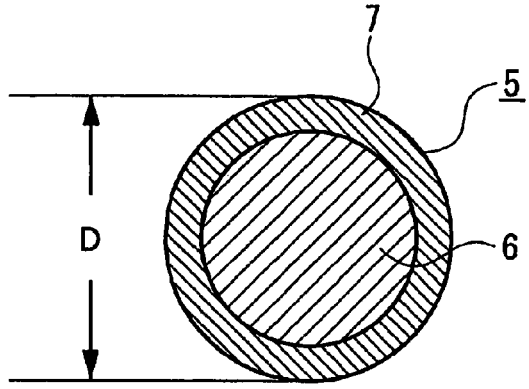

FIG. 7 - - Prior Art - -
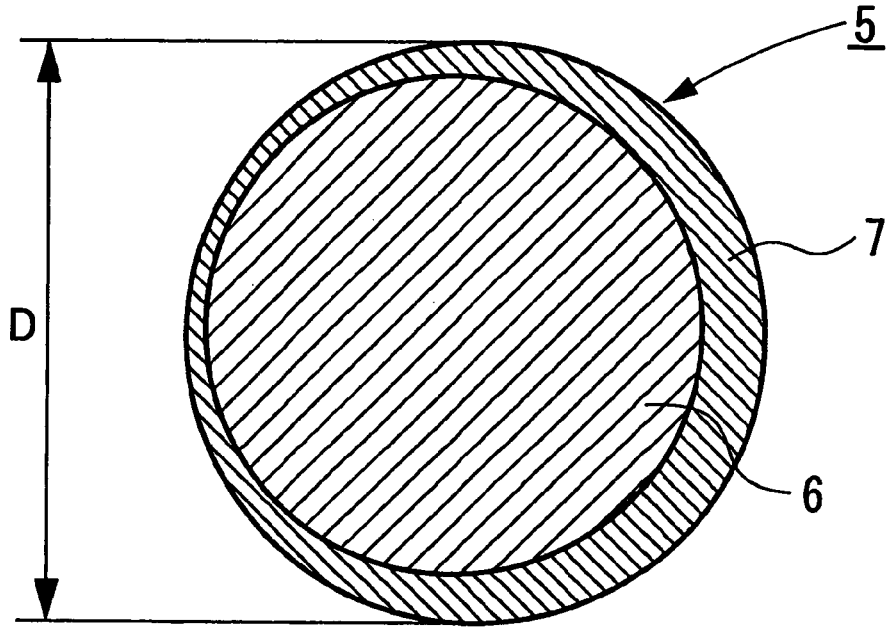

MAGNETRON

BACKGROUND OF THE INVENTION

The present invention relates to a magnetron for use in microwave ovens and so on, and more specifically, it relates to a magnetron having a filament improved to implement a long lifetime.

Generally, a magnetron generates microwaves efficiently and is widely used in application apparatuses, particularly, such as microwave ovens and thawing apparatuses, strongly requiring stability, high quality, long lifetime, and high efficiency.

FIG. 6A shows a cathode assembly of a conventional magnetron which is mounted on home electronic ovens.

The cathode assembly is arranged on a central axis of an anode cylindrical body (not shown). The cathode assembly comprises a rod-shaped center lead pin 1 made of a high melting point metal, a top hat 2, made of a high melting point metal, connected to an upper end of the center lead pin 1 and an end hat 3, made of a high melting point metal, connected to a lower end of the center lead pin 1, side lead pins 4*a* and 4*b*, made of a high melting point metal, connected to the end hat 3, and a helical filament 5 which circles around the center lead pin 1 and whose one end is connected to the top hat 2 and the other end is connected to the end hat 3.

In order to stabilize the electron emission characteristic, the filament 5 has a carbonized layer 7 which covers an outer circumference of a core wire 6 such as a thorium-tungsten wire.

The carbonized layer 7 is formed by electrifying the core wire 6 which is molded in advance in a helical shape of a predetermined dimension under a rare gas atmosphere containing carbon and by increasing a temperature of the core wire 6 higher than that at the time of oscillating as the filament 5.

The carbonized layer 7 of the filament 5 is exhausted gradually as time passes, and, when the carbonized layer 7 is extinct, the electron emission characteristic is degraded so that the magnetron is not available any longer.

Therefore, in order to achieve a long life span of the magnetron, it is desirable that the carbonized layer 7 be formed thick.

However, an outer diameter of a wire material that can be used as the filament 5 is limited to a predetermined range (for example, about ϕ0.5 to 0.6 mm) according to spatial conditions that can be secured in the magnetron and required electrical characteristics. Hence, when the thickness of the carbonized layer 7 is increased, the diameter of the core wire 6 should be reduced accordingly. Further, as the thickness of the carbonized layer 7 is increased, the life span is elongated. However, in this case, a mechanical strength to vibration or shock while carrying is reduced due to a decrease in diameter of the core wire 6, which result in causing a disconnection of the filament or the like. Further, there is a problem in that oscillation performance may be degraded due to degradation of the electrical characteristics.

Thus, in order to secure a long life span without degrading the electrical characteristics or mechanical strength, it is important to properly determine the thickness of the carbonized layer 7 with respect to the range of the diameter of the wire material that can be used as the filament 5.

From such a background, conventionally, there is suggested a technology in which the thickness of the carbonized layer 7 is in a range of 5 to 30 μm, for example, and is limited to less than 5% of the value of the outer diameter D of the wire material including the carbonized layer 7, such that the long life span and the maintenance of the electrical characteristics or the mechanical strength may be stood together (for example, see JP-B-60-53418).

As described above, the carbonized layer 7 of the filament 5 is formed by electrifying the core wire 6 which is molded in advance in the helical shape of the predetermined dimension. The carbonized layer 7 formed with such a manufacturing method does not have a uniform thickness since the center of an outer circumferential circle of the carbonized layer 7 is in an eccentric state with respect to the center of the core wire 6 due to a temperature difference at the time of increasing the temperature, as shown in FIG. 7.

For this reason, as described in Patent Document 1, according to the method in which the thickness of the carbonized layer 7 formed around the outer circumference of the core wire 6 is regulated according to a ratio to the outer diameter D of the wire material, when a location for measuring the thickness of the carbonized layer 7 is deviated, a significant difference in the total amount of the substantially covered carbonized layer 7 occurs.

Specifically, according to the prior art, even when the equipped amount of the carbonized layer 7 is defined, there occurs a significant variation in the total amount of the substantially covered carbonized layer 7. As a result, there is a problem in that a variation in electrical characteristic or mechanical strength easily occurs at the time of serving as the filament 5. Furthermore, there is a problem in that a significant variation in life span also occurs at the time of serving as the magnetron.

In addition, when the electrical characteristics of the filament 5 are different from those of the conventional product, there is also a problem in that compatibility as the magnetron is not implemented.

SUMMARY OF THE INVENTION

The present invention has been made to solve the above-mentioned problems, and it is an object of the present invention to provide a magnetron which prevent a variation in total amount of a carbonized layer formed in a filament from occurring and which has stable quality of a reduced variation in electric characteristic or mechanical strength of the filament and a small variation of a life span of the filament.

Further, it is another object of the present invention to provide a magnetron which can be formed without changing the electrical characteristics of the filament, thereby to secure compatibility with a power supply and so on.

The above-mentioned objects of the present invention are achieved by the following configuration.

A magnetron has a filament acting as a cathode assembly on a central axis of an anode cylindrical body having a plurality of radially arranged vanes, the filament having a carbonized layer around an outer circumference of its core wire. Further, when an outer diameter D1 of the filament including the carbonized layer is ϕ0.53 to 0.56 mm, assuming that a resistance value of the filament before forming the carbonized layer is R1 and a resistance value of the filament after forming the carbonized layer is R2, the thickness of the carbonized layer of the filament is determined such that a carbonization rate Rx defined by the following equation is in a range of from 30 to 50%:

$$R_x=\{(R_2-R_1)/R_1\}\times 100.$$

According to the magnetron described, considering that a resistance value of the filament varies according to a total amount of the carbonized layer, the total amount of the carbonized layer equipped in the filament is controlled by a carbonization rate which is obtained from a change ratio between the resistance value before carbonizing the filament and the resistance value after carbonizing the filament.

For this reason, the filament having an appropriate amount of carbonized layer equipped therein can be stably produced without causing the variation in the total amount of the carbonized layer of the filament. Furthermore, the resistance value required in calculating the carbonization rate can be continuously detected and monitored by connecting a suitable detection circuit to a filament base material during a carbonization process that electrifies the filament base material to form the carbonized layer. Therefore, the formation of the carbonized layer can be managed with high precision.

Further, by managing the final resistance value of the filament and by maintaining electric strength or mechanical strength required for the filament to the same extent as that in the conventional product, the compatibility with the power supply and so on of the magnetron can be secured. In addition, the magnetron having a life span elongated about twice can be stably produced.

BRIEF DESCRIPTION OF THE DRAWINGS

FIG. 6A is a cross-sectional view showing a conventional arrangement of a cathode assembly equipped in a magnetron and FIG. 6B is an enlarged cross-sectional view of a helical filament shown in FIG. 6A;

FIG. 7 is a cross-sectional view showing an aspect of a substantial carbonization layer in the conventional filament.

DETAILED DESCRIPTION OF THE PREFERRED EMBODIMENTS

Hereinafter, a preferred embodiment of the present invention will be described in detail with reference to the drawings.

Figure 1:
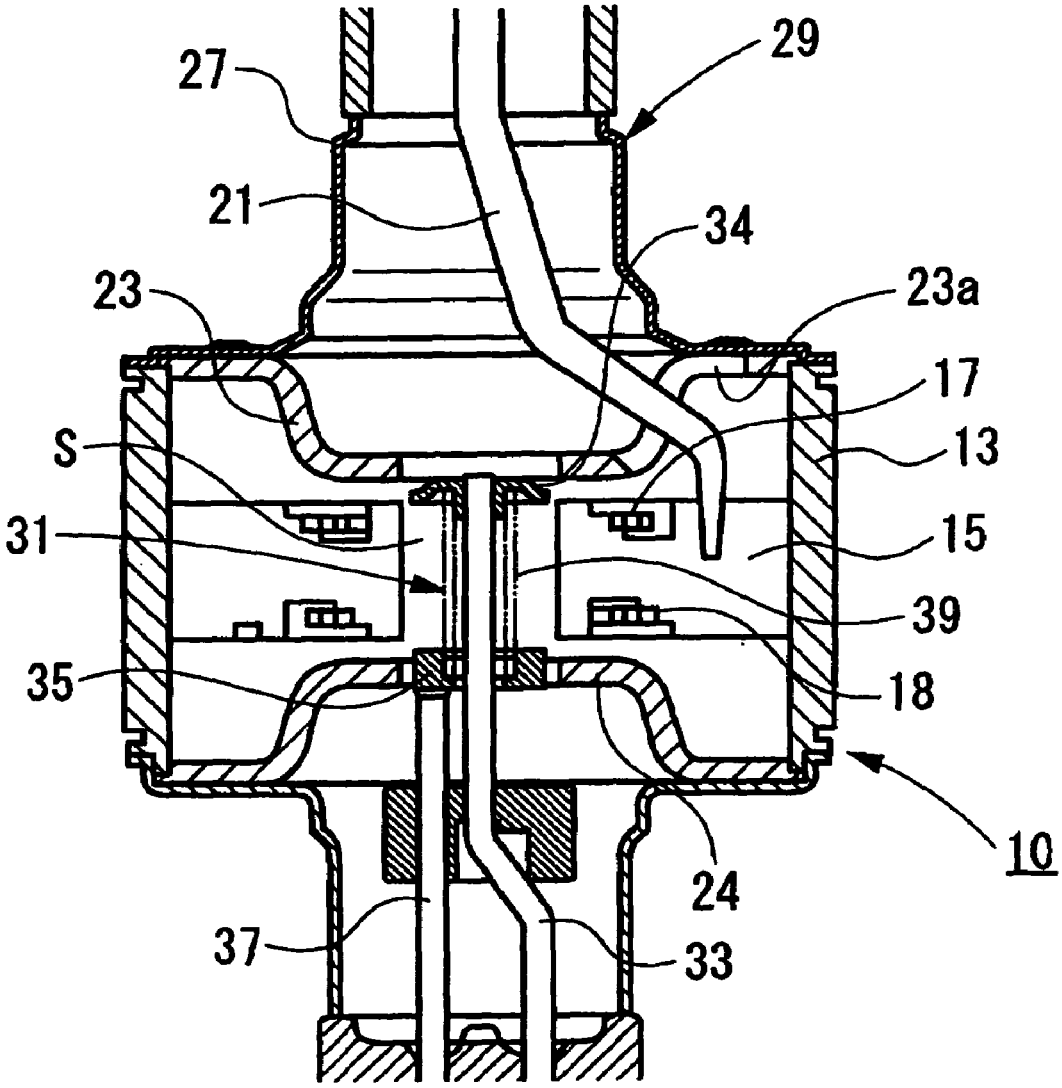
FIG. 1 is a longitudinal cross-sectional view showing a magnetron according to an embodiment of the present invention.

FIG. 1 shows a magnetron according to an embodiment of the present invention.

A magnetron 10 according to the embodiment of the present invention forms a cavity resonator in which even vanes 15 are fixedly arranged on an inner circumferential surface of an anode cylindrical body 13 radially toward on a central axis.

Each of the even vanes 15 has upper and lower end parts which are connected every other one by means of first and second strap links 17 and 18 in pairs. Therefore, an antenna lead 21 is connected to one vane 15 therein.

At both opening end parts of the anode cylindrical body 13, magnetic poles 23 and 24 are provided. The antenna lead 21 has a base end which is connected to an output sideline part (a sideline part near the magnetic pole 23) of the vain 15 and a front end which extends to pass through the magnetic pole 23 and the side tube 27 via a through hole 23*a* provided in the magnetic pole 23.

The anode cylindrical body 13, the vanes 15, the strap links 17 and 18, the magnetic poles 23 and 24, and the antenna lead 21 described above forms an anode portion 29.

Above the central axis of the anode cylindrical body 13, a cathode assembly 31 is arranged.

A space between the anode portion 29 and the cathode assembly 31 arranged on the central part thereof is referred to as an electron active space S.

The cathode assembly 31 comprises a rod-shaped center lead pin 33 made of a high melting point metal, a top hat 34, made of a high melting point metal, connected to an upper end of the center lead pin 33, an end hat 35, made of a high melting point metal, connected to a lower end of the center lead pin 33, a side lead pin 37, made of a high melting point metal, connected to the end hat 35, and a helical filament 39 which circles around the center lead pin 33 and whose one end is connected to the top hat 34 and the other end connected to the end hat 35.

Figure 2:
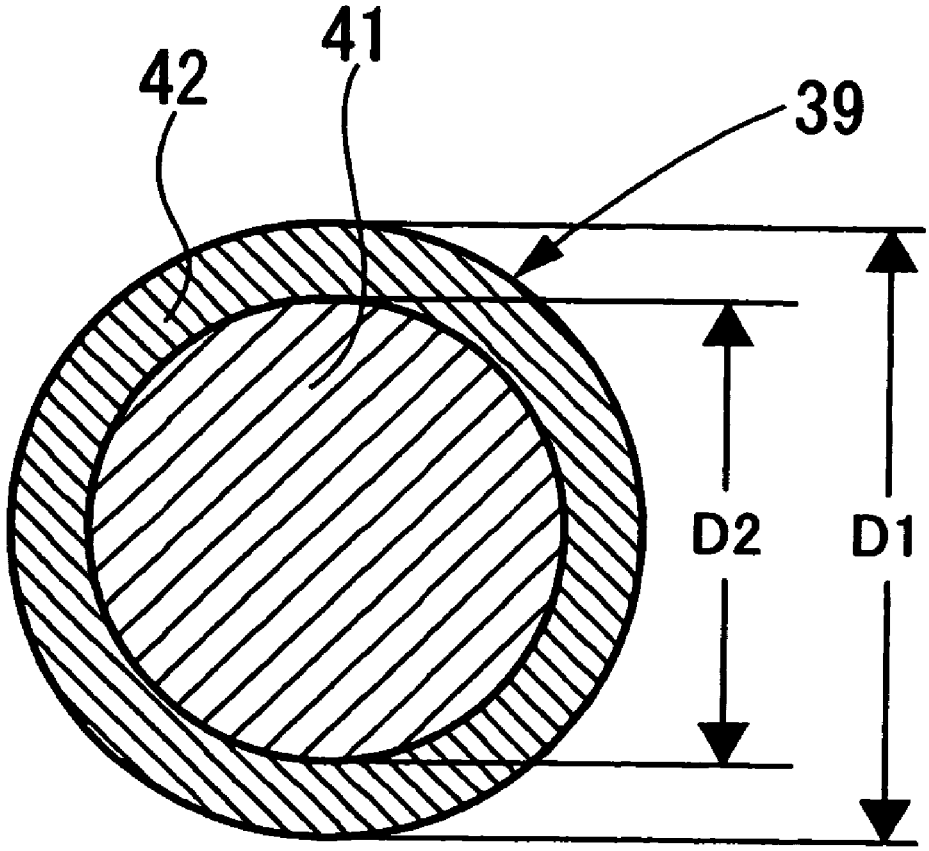
FIG. 2 is a cross-sectional view of a filament shown in FIG. 1.

As shown in FIG. 2, in order to stabilize an electron emission characteristic, the filament 39 has a carbonized layer 42 which covers an outer circumference of a core wire 41 made of a thorium-tungsten wire or the like.

The carbonized layer 42 is formed by electrifying the core wire 41, which is molded in advance in a helical shape of a predetermined dimension, under a rare gas atmosphere containing carbon and by increasing a temperature of the core wire 41 higher than that at the time of oscillating as the filament 39.

In the magnetron 10 of the embodiment of the present invention, assuming that a resistance value of the filament 39 before forming the carbonized layer 42 is R1 and a resistance value of the filament 39 after forming the carbonized layer 42 is R2, a thickness of the carbonized layer 42 of the filament 39 is determined such that a carbonization rate Rx defined by the following equation (1) has a predetermined value:

$$R_x=\{(R_2-R_1)/R_1\}\times 100 \quad (1)$$

In the magnetron 10 described above, considering that the resistance value of the filament 39 varies according to a total amount of the carbonized layer, the total amount of the carbonized layer 42 equipped in the filament 39 is regulated according to the carbonization rate Rx of the above equation (1) which calculates a change ratio between the resistance values before and after carbonizing the filament 39.

For this reason, the filament 39 having an appropriate amount of the carbonized layer 42 equipped thereon can be stably produced without causing a variation in total amount of the carbonized layer 42 of the filament 39.

Furthermore, the resistance value required in calculating the carbonization rate can be continuously detected and monitored by connecting a suitable detection circuit to a filament base material during a carbonization process that electrifies the filament base material to form the carbonized layer 42. Thus, the formation of the carbonized layer 42 can be managed with high precision.

In addition, in order to manage the final resistance value of the filament 39, the electrical characteristics required for the filament 39 can be managed with high precision.

Therefore, it is possible to obtain the magnetron having stable quality in which a variation in total amount of the carbonized layer 42 equipped on the filament 39 can be prevented from occurring, a variation in electrical characteristic or mechanical strength of the filament 39 can be reduced, and further a variation in life span can be reduced.

Further, the electrical characteristics or mechanical strength of the filament can be maintained to the same extent as that of the conventional product, so that the compatibility of the magnetron with respect to a power supply and so on can be secured.

As shown in FIG. 2, assuming an outer diameter of the filament 39 including the carbonized layer 42 is D1 and an outer diameter of the core wire 41 is D2, the carbonization rate Rx which is capable of realizing a long life span without degrading the electrical characteristics or mechanical strength of the filament varies according to the above-mentioned outer diameter D1.

Here, the present inventors has prepared the filaments having various carbonization rates by using three types of wire materials having D1 of ϕ0.50 mm, ϕ0.53 mm, and ϕ0.56 mm, respectively. And then, we have examined a correlation between the carbonization rate and the outer diameter D2 of the core wire, a correlation between a cathode resistance and a filament current with respect to the respective carbonization rates of the filaments, and a correlation between the carbonization rate and the life span of the filament, for the filaments.

Figure 3:
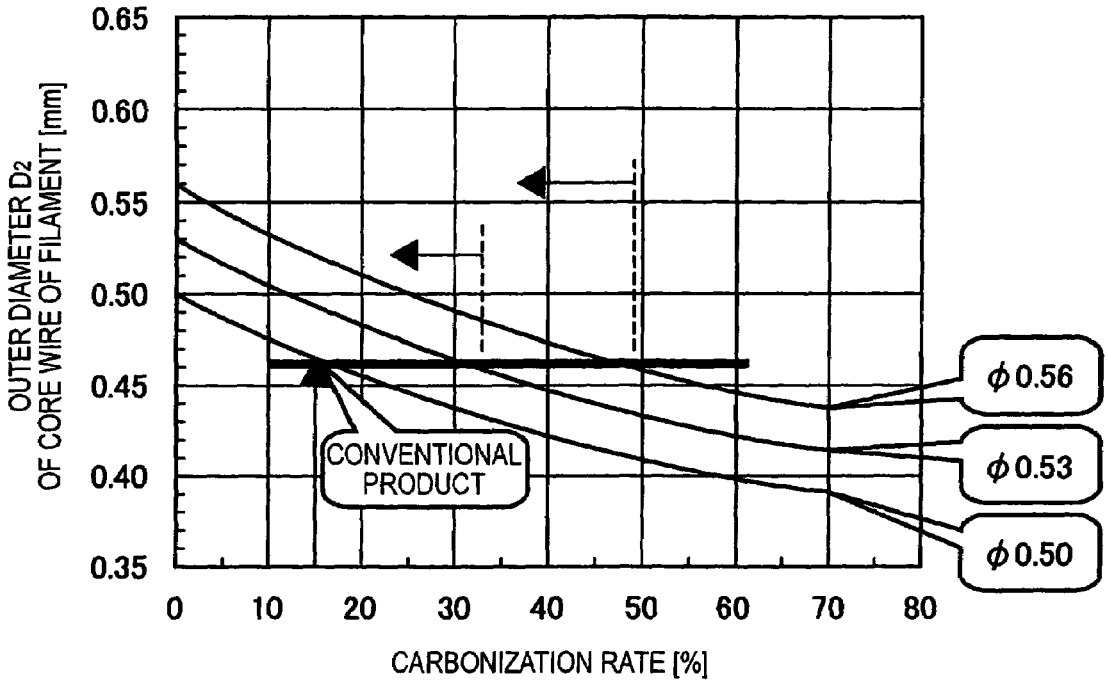
FIG. 3 is a diagram showing a correlation between an outer diameter of a core wire and a carbonization rate of the filament.
Figure 4:
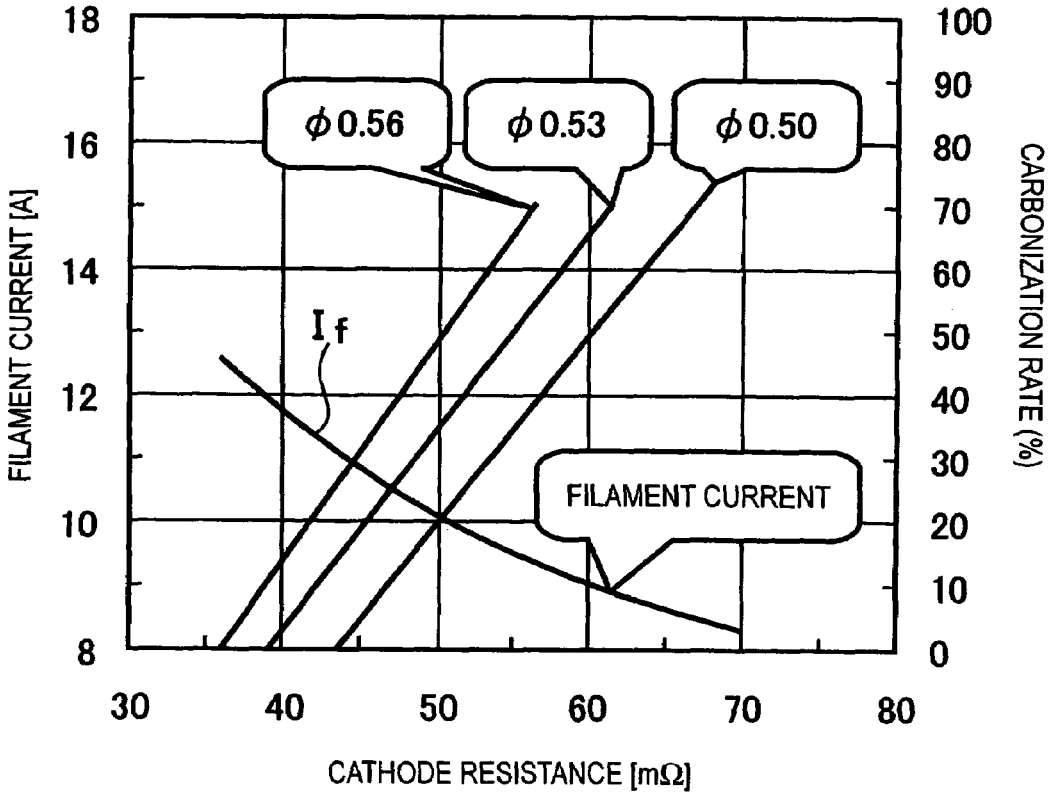
FIG. 4 is a diagram showing a correlation between a cathode resistance and a filament current with respect to the respective carbonization rates of the filaments.
Figure 5:
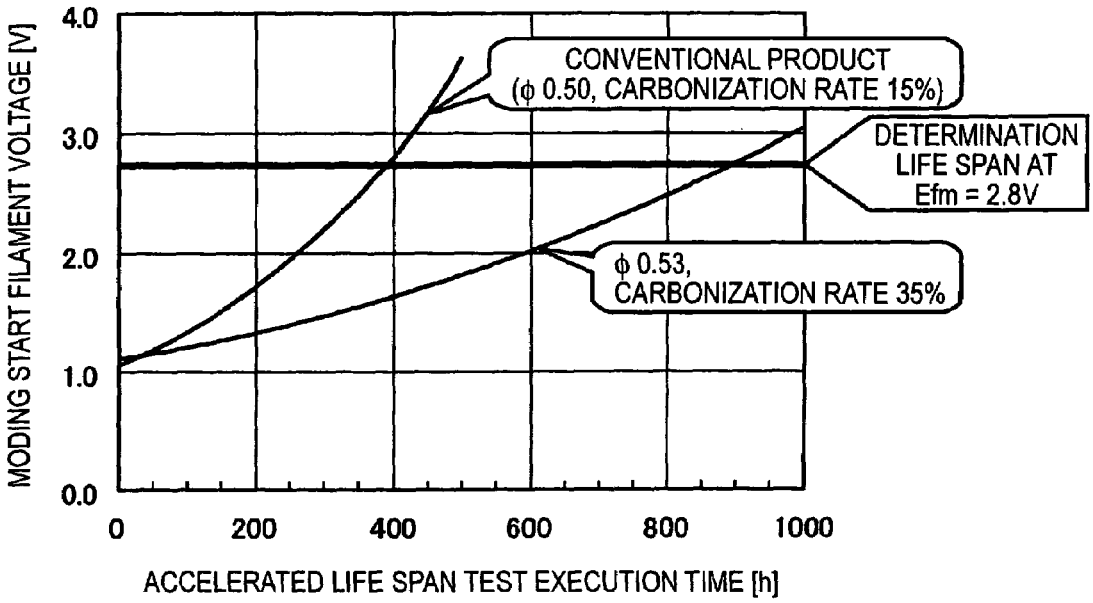
FIG. 5 is a diagram showing a correlation between a carbonization rate and a life span of the filament.

The correlation between the outer diameter D2 of the core wire and the carbonization rate is shown in FIG. 3. Further, the correlation between the cathode resistance and the filament current with respect to the respective carbonization rates of the filaments is shown in FIG. 4. In addition, the correlation between the carbonization rate and the life span of the filament is shown in FIG. 5.

Moreover, in the conventional filament, with the outer diameter D1 of the wire material is ϕ0.50 mm, the total amount of the carbonized layer converted into the above carbonization rate Rx is about 15%, and the outer diameter D2 of the core wire is about 0.46 mm.

In order to obtain the electrical characteristics or mechanical strength as much as that in the conventional filament and increase the life span, the outer diameter D2 of the core wire is preferably more than or equal to 0.46 mm. Further, the outer diameter D1 of the wire material of the filament base material and the carbonization rate Rx may be determined such that the carbonization rate increases as compared to the conventional filament.

Specifically, as shown in FIG. 3, in a case in which the wire material having the outer diameter D1 of ϕ0.53 mm is adopted as the filament base material, when the carbonization rate is set to be in a range of 15 to 32%, the outer diameter D2 of the core wire 41 is more than or equal to 0.46 mm and the carbonization rate increases as compared to the conventional filament. Thus, the filament having the long life span as compared to the conventional filament can be implemented without degrading the electrical characteristics or the mechanical strength of the filament.

Similarly, in a case in which the wire material having the outer diameter D1 of ϕ0.56 mm is adopted as the filament base material, when the carbonization rate is set to be in a range of 15 to 49%, the outer diameter D2 of the core 41 is more than or equal to 0.46 mm and the carbonization rate increases as compared to the conventional filament. Thus, the filament having the long life span as compared to the conventional filament can be implemented without degrading the electrical characteristics or mechanical strength of the filament.

Moreover, the filament current which is one of the electrical characteristics of the filament tends to decrease as the cathode resistance increases, as shown in a curve If of FIG. 4. In order to maintain the electrical characteristics to the same extent as those of the conventional filament in which the wire material having the outer diameter D1 of ϕ0.50 mm is adopted as the filament base material, thereby maintaining compatibility with the conventional products, the carbonization rate may be controlled in a range of from 30 to 50% by comparing the carbonization rate shown in the right side of FIG. 4.

In fact, the filament of the present invention in which the wire material having the outer diameter D1 of ϕ0.53 mm is adopted as the filament base material and the carbonized layer is formed with the carbonization rate of about 35% has the life span about twice as long as the conventional filament, as compared to the conventional filament in which the wire material having the outer diameter D1 of ϕ0.50 mm is adopted as the filament base material and the carbonized layer is formed with the carbonization rate of about 15%, as shown in FIG. 5.

Moreover, the outer diameter D1 of wire material which is adopted as the filament base material is not limited to the ϕ0.53 mm and ϕ0.56 mm described above. According to tests and operations by the present inventors, any wire materials having the outer diameter in a range of from ϕ0.53 to 0.56 mm may be adopted. Therefore, when the carbonized layer 42 is formed on the filament 39 made of the wire material having the outer diameter D1 in the range of from ϕ0.53 to 0.56 mm to have the carbonization rate of from 30 to 50%, it can be seen that the magnetron having the long life span can be stably produced without degrading the electrical characteristics or mechanical strength of the filament, as compared with the conventional filament.

What is claimed is:

1. A magnetron comprising:

an anode cylindrical body having a plurality of radially arranged vanes;

a cathode assembly having a filament provided on a central axis of the anode cylindrical body, the filament having a core wire and a carbonized layer around an outer circumference of the core wire, wherein, when an outer diameter D1 of the filament including the carbonized layer is ϕ0.53 to 0.56 mm, assuming that a resistance value of the filament before forming the carbonized layer is R1 and a resistance value of the filament after forming the carbonized layer is R2, the thickness of the carbonized layer of the filament is determined such that a carbonization rate Rx defined by the equation "$R_x\{(R_2-R_1)/R_1\}\times 100$" is in a range of from 30 to 50%.

* * * * *